United States Patent [19]

Ollivier et al.

[11] Patent Number: 4,610,382

[45] Date of Patent: Sep. 9, 1986

[54] DISK MAGAZINE WITH ANTI-STRESS HOLES

[75] Inventors: Jean Ollivier, Valence; Roland Almeras, Tournon, both of France

[73] Assignee: Illinois Tool Works Inc., Chicago, Ill.

[21] Appl. No.: 615,492

[22] Filed: May 30, 1984

[51] Int. Cl.[4] ..... B25C 1/18; F41C 25/00

[52] U.S. Cl. ..... 227/9; 42/89

[58] Field of Search ..... 42/89; 102/530, 531; 227/8, 9, 10, 11

[56] References Cited

U.S. PATENT DOCUMENTS 1,202,343 10/1916 Wesson et al. ..... 42/89
3,523,383 8/1970 Sposimo ..... 42/89 X
3,921,326 11/1975 Hupp et al. ..... 42/89

FOREIGN PATENT DOCUMENTS 1923911 11/1970 Fed. Rep. of Germany ..... 227/10
2031994 8/1971 Fed. Rep. of Germany .

*Primary Examiner*—Paul A. Bell
*Attorney, Agent, or Firm*—David I. Roche; Thomas W. Buckman

[57] ABSTRACT

The tool comprises between a barrel and a breech, a rotating loader disc provided with orifices for receiving propellant charges. Between these charge-receiving orifices there are orifices for inhibiting the sympathetic ignition of the adjacent charges.

10 Claims, 3 Drawing Figures

DISK MAGAZINE WITH ANTI-STRESS HOLES

BACKGROUND AND SUMMARY OF THE INVENTION

The present invention relates to a fastener driving tool, or like apparatus, comprising a barrel adapted to receive a fastener intended to be driven in translation in the barrel under the action of the combustion gases of a propellant charge, a breech in which a striker is slidingly mounted, a loader carrying propellant charges, between the barrel and the breech, provided with orifices for receiving the propellant charges, and means for driving the loader in displacement.

Patent DT-AS No. 2,031,994 describes a tool of this type, in which the loader is a loader in the form of an annular disc mounted to rotate on itself, of which the orifices for receiving the propellant charges are angularly spaced apart in regular manner, and which is provided with peripheral teeth adapted to cooperate with a drive lever which may be actuated by a cocking lever in order, during cocking of the tool, to drive the loader in rotation over an angular distance equal to that separating two adjacent orifices and thus to present a fresh charge opposite the striker of the breech.

The adoption of such a loader follows from the requirement that a maximum of propellant charges be disposed in a minimum of space. The orifices for receiving the charges are therefore very close to one another.

With such a tool, in which the charges are therefore very close to one another, upon firing of one of these charges, the two charges adjacent thereto may well be fired also by sympathetic ignition, via the loader itself which constitutes a support of propagation of the mechanical stress created by the firing of the charge in question.

The fact of spacing the charge-receiving orifices apart on the loader would not constitute a satisfactory solution since this would be to the detriment of the quantity of charges available on the loader or of the dimensions of this loader.

It is an object of the present invention to eliminate or considerably reduce the risk of firing, by sympathetic ignition, the propellant charges disposed on the loader of a tool of the above mentioned type.

To this end, the present invention relates to a tool of this type, characterized in that the loader comprises means adapted to form an obstacle to the propagation of the mechanical stress created by the firing of a propellant charge.

Thanks to the obstacles according to the invention, the propagation of the stress is considerably inhibited, failing complete stoppage; and when said stress reaches one or the other of the adjacent charges, its level is such that the risk of sympathetic ignition is considerably reduced, if not zero.

Naturally, the scope of this invention is not intended to be limited to loaders mounted to rotate on themselves.

In a preferred embodiment of the invention, the loader comprises small, sympathetic ignition inhibiting orifices adjacent the charge-receiving orifices, at least one adjacent each of the charge-receiving orifices, advantageously arranged outside the line of the centers of two adjacent charge-receiving orifices, on one side or the other.

The invention is, of course, applicable both to direct firing tools and to indirect firing piston tools. It will be recalled that, in tools of the latter type, a fastener is driven therein under the action of the combustion gases via a piston mounted to slide in the barrel.

BRIEF DESCRIPTION OF THE DRAWING

The invention will be more readily understood on reading the following description with reference to the accompanying drawings, in which.

DETAILED DESCRIPTION OF THE PREFERRED EMBODIMENTS

Figure 1:
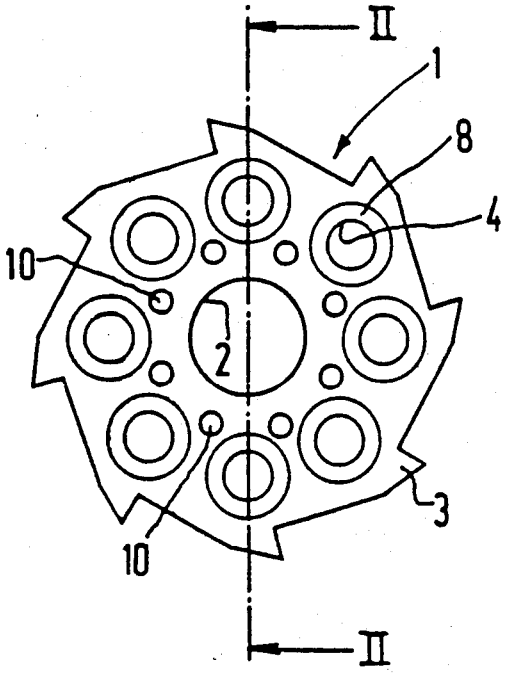
FIG. 1 is a front view of a preferred embodiment of the loader of the tool according to the invention, without propellant charges.
Figure 2:
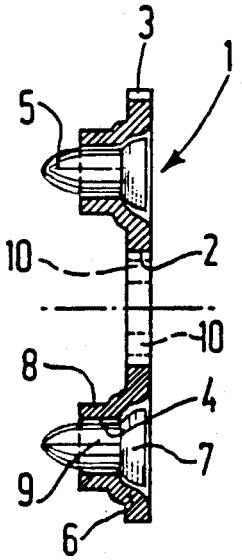
FIG. 2 is a view in section along line II—II of FIG. 1, the loader being shown with only two charge-receiving orifices and the two corresponding charges, for reasons of clarity of the drawing.
Figure 3:
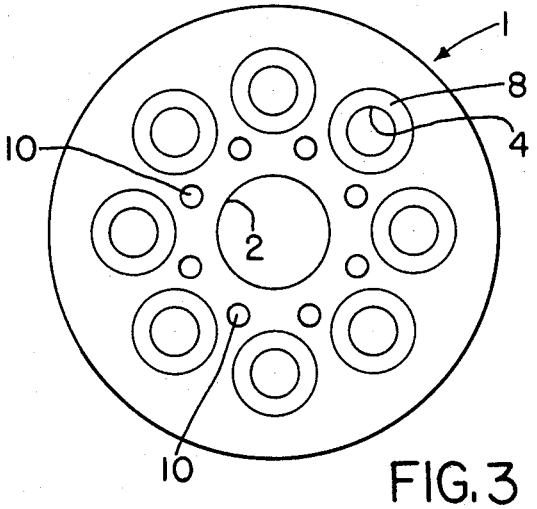

Referring now to the drawings, the loader 1 is that of a fastener driving tool with a piston or like apparatus. It comprises a barrel holder; a barrel mounted to slide in the barrel holder, a piston mounted to slide in the barrel in order, under the action of the combustion gases produced by the firing of a propellant charge, to drive in translation in the barrel a fastener previoulsy introduced in the barrel before this fastener penetrates in a material adapted to receive it, a breech in which a striker is slidably mounted, and the loader 1, disposed between the barrel and the breech. Apart from the loader 1, the above elements of the tool according to the invention, as well as all the others, have not to be described in greater detail nor be illustrated in the drawings, as they are well known to any man skilled in the art.

The loader 1 is in the general form of an annular disc, formed for example in a plate, preferably of sheet metal, of relatively small thickness.

It is provided with a central orifice 2 by which it is mounted freely on a hub fast with a rocking lever adapted to pivot on the barrel holder between an outer position of loading of the loader and an inner position of operation, in which it is in contact with the front wall of the breech. The means for supporting the loader 1 are also known to the man skilled in the art, for example by Patent DT-AS 2,031,994.

The loader 1 comprises on its periphery teeth 3 adapted to cooperate with a drive lever, itself actuated by a cocking lever during cocking of the tool, thus causing the loader 1 to rotate step by step on its hub, against the action of elastic non-return means, to present at each step a fresh propellant charge opposite the striker of the breech on the one hand and the combustion chamber of the barrel on the other hand.

The loader 1 is provided with through orifices 4 for receiving propellant charges 5. These are circular orifices spaced apart angularly in regular manner, all at the same radial distance from the center of the loader. The charge-receiving orifices are closely spaced, i.e. their number is high, eight in the example shown. The wall of the orifices 4 have been shaped, in conventional manner, so as to follow the form of the charges 5. The rear part 6 of the wall of the orifices is thus shaped to receive the flange 7 of the cartridge case of the charges. This rear wall 6 is extended forwardly by a short tubular skirt 8 receiving part of the case 9.

The loader 1 is also provided with other inhibiting through orifices 10.

In the example shown, these orifices 10 are small circular orifices, advantageously of smaller diameter than that of the charge-receiving orifices 4, spaced apart angularly in regular manner, all at the same radial distance from the center of the loader 1.

This radial distance from the center of the loader 1 is, in the present case, shorter than that at which the charge-receiving orifices 4 are disposed, but it might equally well have been longer. It should therefore be noted that, in either case, the inhibition orifices 10 are made outside the segments of straight line joining the centers of two adjacent charge-receiving orifices 4, on one side or the other. The inhibition orifices 10 are disposed substantially opposite the center points of these segments of straight line.

The orifices 10, eight in number in the present example, act as obstacles to the propagation of the mechanical stress created by the firing of a propellant charge in question and therefore have for their effect to inhibit or at least considerably reduce the risk of firing by sympathetic ignition of the propellant charges adjacent the charge in question.

In other words, the inhibiting orifices 10 must prevent the mechanical stress created at one charge 5 from overly stressing, via the loader itself, the flange 7 of the cartridge case of the adjacent charges.

The drawings show a loader comprising, between two adjacent charge-receiving orifices 4, one single circular inhibiting orifice. It is clear that, to reduce the level of the mechanical stress at a charge-receiving orifice, non-circular inhibiting orifices may be provided, for example in the form of a slot, and more than one, for example two, may be disposed between two charge-receiving orifices.

A loader mounted to rotate on a hub has been described. The scope of the invention would, of course, not be exceeded with a loader mounted on rotate within a housing.

Neither would the scope be exceeded by not providing teeth for driving in rotation, but drive means acting directly on the projecting part of the charges, thus performing the role of drive pin.

Finally, the invention has been described with reference to a fastener driving tool, but it is clear that it is applicable to any other tool assimilable thereto.

What is claimed is:

1. In a fastener driving tool powered by blank rimfire cartridges, a metallic loader for carrying the cartridges and provided with closely spaced orifices for receiving the cartridges and holding the cartridges before, during, and after firing in the tool, the loader having stress relief means for preventing the propagation of enough of the mechanical stress created by the firing of one cartridge to the rim of an adjacent cartridge to fire the adjacent cartridge whereby the metallic loader may be compact without having any sympathetic ignitions.

2. The loader of claim 1, wherein the loader comprises, adjacent each cartridge orifices, a small orifice for inhibiting the sympathetic ignition of adjacent propellant charges.

3. The loader of claim 2, wherein the inhibiting orifice is located between two adjacent cartridge-receiving orifices.

4. The loader of one of claim 2, characterized in that the inhibiting orifices are made outside the line of the centers of two adjacent cartridge-receiving orifices, whereby to allow close spacing of the cartridges in the loader without causing sympathetic ignition of adjacent cartridges.

5. The loader of one of claim 2 wherein the inhibiting orifices are circular.

6. The loader of claim 1 wherein the loader is in the general form of an annular disc adapted to be mounted to rotate on itself.

7. The loader of claim 6, characterized in that the inhibiting orifices are disposed at a distance from the center of the loader disc which is shorter than that at which the cartridge-receiving orifices are located.

8. A metallic loader for carrying cartridges for use in a fastener driving tool powered by blank rimfire cartridges, which loader comprises:

a flat metallic annular disc having a true annular shape with a substantially smooth continuous radially inward facing surface and a substantially smooth continuous radially outward facing surface and provided with a plurality of closely spaced orifices for receiving the cartridges and holding the cartridges before, during and after firing in the tool and provided with stress relief orifices of closed circular shape disposed between the two surfaces and located closer to adjacent cartridge holding distance between adjacent orifices than the cartridge holding orifices whereby preventing propagation of enough of the mechanical stresses created by firing of one of said cartridges to the rim of an adjacent cartridge to fire the adjacent cartridge so that the loader may be compact without having any sympathetic ingitions.

9. The loader of claim 8 wherein second orifices are placed circumferentially between the first orifices.

10. The loader of claim 8 wherein the second and first orifices are radially aligned.

* * * * *

UNITED STATES PATENT OFFICE

CERTIFICATE OF CORRECTION

Patent No. 4,610,382 Dated September 9, 1986

Inventor(s) Jean Ollivier and Roland Almeras

It is certified that error appears in the above-identified patent and that said Letters Patent are hereby corrected as shown below:

Claim 1 should read as follows:

1. In a fastener driving tool powered by blank rimfire cartridges, a metallic loader for carrying the cartridges and provided with closely spaced orifices for receiving the cartridges and holding the cartridges before, during and after firing in the tool, the loader having stress relief orifices which are located closer to adjacent orifices than the distance between adjacent orifices for preventing the propagation of enough of the mechanical stresses created by firing of one cartridge to the rim of an adjacent cartridge to fire the adjacent cartridge whereby the metallic loader may be compact without having any sympathetic ignitions, said loader having a true annular shape with a substantially smooth continuous radially inward facing surface and a substantially smooth continuous radially outward facing surface and said orifices being closed circles disposed between the two surfaces.

Signed and Sealed this

Twenty-fourth Day of January, 1989

*Attest:*

DONALD J. QUIGG

*Attesting Officer* *Commissioner of Patents and Trademarks*